US007372197B2

(12) United States Patent
Ahn et al.

(10) Patent No.: US 7,372,197 B2
(45) Date of Patent: May 13, 2008

(54) FIELD EMISSION DEVICE AND FIELD EMISSION DISPLAY INCLUDING DUAL CATHODE ELECTRODES

(75) Inventors: Pil-soo Ahn, Suwon-si (KR); Hang-woo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 520 days.

(21) Appl. No.: 11/059,437

(22) Filed: Feb. 17, 2005

(65) Prior Publication Data

US 2005/0194887 A1 Sep. 8, 2005

(30) Foreign Application Priority Data

Feb. 20, 2004 (KR) ..... 10-2004-0011482

(51) Int. Cl.
*H01J 1/30* (2006.01)

(52) U.S. Cl. ..... 313/495; 313/497; 313/309; 313/336; 313/351

(58) Field of Classification Search ..... 313/495, 313/497, 306–309, 336, 351
See application file for complete search history.

(56) References Cited

U.S. PATENT DOCUMENTS 5,148,078 A * 9/1992 Kane ..... 313/307
5,969,467 A * 10/1999 Matsuno ..... 313/309
6,057,636 A * 5/2000 Sakai et al. ..... 313/306
6,741,016 B2 * 5/2004 Benning et al. ..... 313/309

FOREIGN PATENT DOCUMENTS

JP 8-222122 A 8/1996

* cited by examiner

*Primary Examiner*—Ashok Patel
(74) *Attorney, Agent, or Firm*—Sughrue Mion, PLLC

(57) ABSTRACT

A field emission device and a field emission display (FED) having dual cathode electrodes. The field emission device includes a substrate; a first cathode electrode formed on the substrate; a cathode insulating layer formed on the first cathode electrode, and having a first cavity that exposes a portion of the first cathode electrode; an electron emission source disposed on the first cathode electrode and being exposed by the first cavity; a second cathode electrode formed on the cathode insulating layer, and including a cathode hole aligned with the first cavity; a gate insulating layer formed on the second cathode electrode, and having a second cavity aligned with the first cavity; and a gate electrode formed on the gate insulating layer, and having a gate hole aligned with the second cavity.

16 Claims, 5 Drawing Sheets

FIELD EMISSION DEVICE AND FIELD EMISSION DISPLAY INCLUDING DUAL CATHODE ELECTRODES

BACKGROUND OF THE INVENTION

This application claims the priority of Korean Patent Application No. 2004-11482, filed on Feb. 20, 2004, in the Korean Intellectual Property Office, the disclosure of which is incorporated herein in its entirety by reference.

1. Field of the Invention

The present invention relates to a field emission device and a field emission display having dual cathode electrodes, and more particularly, to a field emission device having dual cathode electrodes disposed beneath a gate electrode and a field emission display including the same.

2. Description of the Related Art

Displays, essential for communicating information, have been adapted for use as personal computer and television monitors. Displays can be grouped into a cathode ray tube (CRT) which operates based on discharge of thermoelectrons at high speed, and a flat panel display which has widely been used in recent years. The flat panel display includes a liquid crystal display (LCD), a plasma display (PDP), and a field emission display (FED).

The FED is a display, in which a strong electric field is applied from a gate electrode to electron emission sources arranged on a cathode electrode with predetermined intervals therebetween, thereby emitting electrons from the electron emission sources, and emitting light by collision of the electrons onto a fluorescent material of an anode electrode. A micro tip that is made of a metal such as Mo has typically been used as the electron emission source of a FED in the conventional art. The metal tip has been replaced by a carbon nanotube (CNT) in recent years. The FED employing a CNT provides advantages such as a wide viewing angle, high definition, lower power consumption and temperature stability, and can thus be used in various fields such as car navigation and as a view finder of an electric image apparatus. Especially, the FED can be used as a substitute display for a personal computer, a personal data assistant (PDA) terminal, medical equipment, or a high definition television (HDTV).

FIGS. 1 and 2 show two structures of a conventional FED.

Referring to FIG. 1, a conventional FED includes a substrate 10, a cathode electrode 11 successively stacked on the substrate 10, a first insulating layer 12, a first gate electrode 13, a second insulating layer 14, and a second gate electrode 15. The first and second insulating layers 12 and 14 have a cavity 17 having a predetermined diameter, and a first gate hole 13*a* and a second gate hole 15*a* are formed on the first and second gate electrodes 13 and 15 so as to be aligned with the cavity 17. In addition, an electron emission source 19 is disposed on the cathode electrode 11, which is exposed through the cavity 17. A glass substrate is generally used as the substrate 10, and the cathode electrode 11 is formed of indium tin oxide (ITO), that is, a conductive transparent material. The electron source 19 is generally made of CNT or the metal tip described above.

Referring to FIG. 2, the conventional FED includes a substrate 20, a cathode electrode 21 stacked on the substrate 20, a first insulating layer 22, a first gate electrode 23, a second insulating layer 24, and a second gate electrode 25. In addition, a first cavity 27 and a first gate hole 23*a*, which have the same diameters, are formed on the first insulating layer 22 and the first gate electrode 23, and a second cavity 28 and a second gate hole 25*a*, which have larger diameters than that of the first cavity 27, are formed on the second insulating layer 24 and the second gate electrode 25. The CNT or the metal tip as the electron emission source is disposed inside the first cavity 27.

As shown in FIGS. 1 and 2, the FED having a dual-gate electrode structure controls a voltage applied to the second gate electrodes 15 and 25 so as to prevent an electron beam emitted from the electron discharging sources 19 and 20 from diverging. Accordingly, the electron beam can be focused to a desired position with a beam spot of small size, such that higher image quality can be realized. Also, in a field emission display having the above described FED, an electric arc generated between the electron emission source and an anode electrode can be discharged through the second gate electrodes 15 and 25 that are arranged closer to the anode electrode. Therefore, the electric arc does not directly affect the electron emission sources 19 and 29 that emit the electron beam, the cathode electrodes 11 and 21, and the first gate electrodes 13 and 23.

Specifically, the FED device having the structure shown in FIG. 1 having a narrow and deep cavity 17 and gate holes 13*a* and 25*a* provides enhanced focusing of the electron beam emitted from the electron emission source 19. The FED device having the structure shown in FIG. 2 has a wide second cavity 28 and a wide second gate hole 25*a*, and thus can be manufactured more easily.

FIG. 3 is a graph illustrating a simulation of electron speed at a position apart from the gate electrode. As shown in FIG. 3, the electrons extracted by the gate electrode are accelerated while moving towards the anode electrode which faces the field emission device. Thus, the electron beam is more effectively focused at an initial stage of emission before the electrons are highly accelerated.

In a FED device having the dual-gate electrode structures shown in FIGS. 1 and 2, the beam can be focused to a greater degree than that of a FED device having a single gate electrode. However, when the electron beam is focused by a second gate electrode that is 5~10 μm apart from the first gate electrode, it is the accelerated electron beam that is focused. Thus the focusing efficiency is lowered.

SUMMARY OF THE INVENTION

It is therefore an object of the present invention to provide a field emission device having enhanced focusing capability. The invention has been achieved by disposing dual cathode electrodes beneath a gate electrode that deflects electrons from an electron emission source so as to focus the electron beam.

The present invention also provides a field emission display (FED) including the field emission device.

According to a first aspect, the present invention provides a field emission device including a substrate; a first cathode electrode formed on the substrate; a cathode insulating layer formed on the first cathode electrode, and having a first cavity that exposes a portion of the first cathode electrode; an electron emission source disposed on the first cathode electrode, the electron emission source being exposed by the first cavity; a second cathode electrode formed on the cathode insulating layer, and including a cathode hole corresponding to, or more particularly, aligned with the first cavity; a gate insulating layer formed on the second cathode electrode, and having a second cavity corresponding to the first cavity; and a gate electrode formed on the gate insulating layer, and having a gate hole corresponding to the second cavity.

According to another aspect, the present invention provides a field emission display including a front substrate and a rear substrate facing each other with a predetermined interval therebetween; an anode electrode and a fluorescent layer successively stacked on an inner surface of the front substrate; a first cathode electrode formed on the rear substrate; a cathode insulating layer formed on the first cathode electrode, and having a first cavity that exposes a portion of the first cathode electrode; an electron emission source disposed on the first cathode electrode, the electrode emission source being exposed by the first cavity; a second cathode electrode formed on the cathode insulating layer, and including a cathode hole corresponding to the first cavity; a gate insulating layer formed on the second cathode electrode, and having a second cavity corresponding to the first cavity; and a gate electrode formed on the gate insulating layer, and having a gate hole corresponding to the second cavity.

The diameter of the cathode hole may be larger than that of the first cavity.

The diameter of the gate hole may be larger than that of the second cavity.

The second cavity may have a diameter that is the same as that of the first cavity, and the gate hole may have a diameter that is larger than that of the cathode hole.

The electron emission source may comprise a carbon nanotube.

The height of the cathode insulating layer, relative to the substrate, may be higher than that of the electron emission source.

The cathode insulating layer may be formed to a thickness of 2~3 μm, and the second cathode electrode may be formed to a thickness of 100~150 μm.

The first and second cathode electrodes may be common (ground) electrodes.

The term "corresponding to" as used herein means "aligned with". For example, as shown in FIG. 4, gate hole 160*a* is vertically aligned with cavity 172 so that the opening of gate hole 160*a* overlays the opening of cavity 172. The respective openings are preferably but not necessarily concentric.

BRIEF DESCRIPTION OF THE DRAWINGS

The above and other features and advantages of the present invention will become more apparent by the following detailed description of exemplary embodiments with reference to the attached drawings in which.

DETAILED DESCRIPTION OF THE INVENTION

Figure 1:
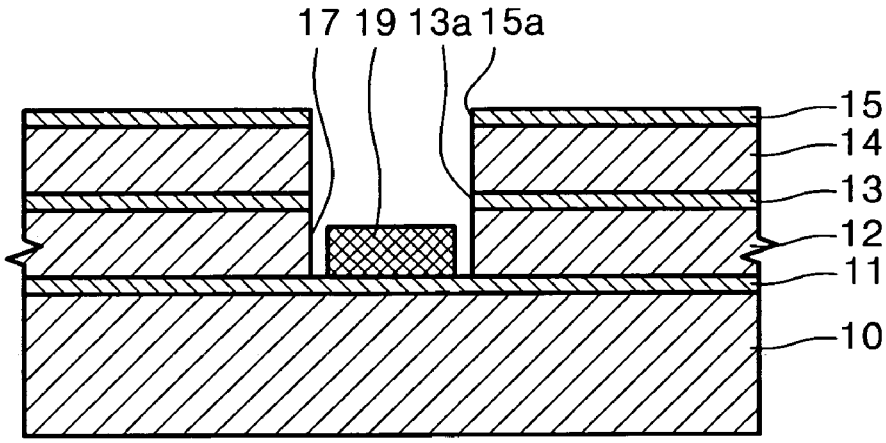
FIG. 1 (PRIOR ART)
FIG. 1 is a cross-sectional view illustrating an example of a conventional field emission device.
Figure 2:
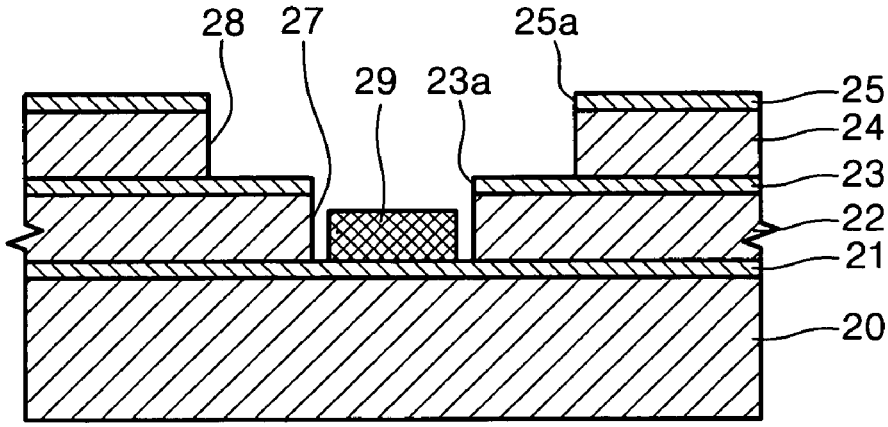
FIG. 2 (PRIOR ART)
FIG. 2 is a cross-sectional view illustrating another example of a conventional field emission device.

Hereinafter, a field emission device having a second cathode electrode and a field emission display (FED) according to the present invention will be described with reference to the accompanying drawings. However, the present invention should not be construed as being limited thereto. In the drawings, the thicknesses of layers and regions are exaggerated for clarity.

Figure 4:
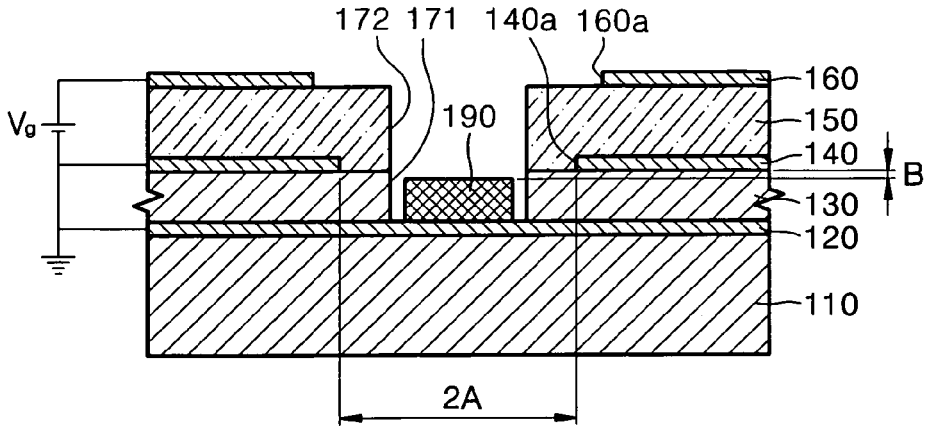
FIG. 4 is a cross-sectional view illustrating a structure of a field emission device according to an exemplary embodiment of the present invention.

FIG. 4 is a cross-sectional view illustrating a structure of a field emission device according to an exemplary embodiment of the present invention.

Referring to FIG. 4, the field emission device according to the present invention includes a substrate 110, a first cathode electrode 120 and a cathode insulating layer 130 that are successively stacked on the substrate 110, and a second cathode electrode 140 disposed on the cathode insulating layer 130. A gate insulating layer 150 and a gate electrode 160 are sequentially formed on the second cathode electrode 140.

A glass substrate, that is, an insulating material can be used as the substrate 110, and the first cathode electrode 120 and the second cathode electrode 140 are manufactured using a conductive material, for example, indium tin oxide (ITO) or chrome (Cr). The electrodes 120 and 140 are desirably formed to have a thickness of about 100~150 nm.

In addition, the cathode insulating layer 130 and the gate insulating layer 150 respectively have cavities 171, and 172 of predetermined diameters, which cavities expose a portion of the first cathode electrode 120. An electron emission source 190 is disposed on the first cathode electrode 120 in a portion exposed by the cavities 171 and 172. The cavities 171 and 172 can be formed to have the same diameters as each other, or can be formed so that the cavity 172 has a larger diameter than that of the cavity 171.

A micro tip formed of a metal such as molybdenum (Mo) can be used as the electron emission source 190, however, a carbon nanotube (CNT) is desirably used as the electron emission source 190. This is because a CNT has advantages such as a wide viewing angle, high definition, low power consumption, and temperature stability.

The second cathode electrode 140 is disposed between the cathode insulating layer 130 and the gate insulating layer 150. The insulating layers 130 and 150 are formed of silicon oxide. The cathode insulating layer 130 is desirably formed to a thickness of about 2~3 μm by a deposition method.

In addition, a cathode hole 140*a* having a diameter larger than those of the cavities 171 and 172 is formed on the second cathode electrode 140, and a layer of an insulating material is formed between an inner circumferential surface of the cathode hole 140*a* of the second cathode electrode 140 and an inner circumferential surface of the cavity 171 or 172. In this manner, the second cathode electrode 140 is not exposed to the inner circumferential surface of the cavity 171 or 172.

The gate electrode 160 is formed on the gate insulating layer 150, and has a gate hole 160*a* that is aligned with cavity 172. The diameter of the gate hole 160*a* may be the same as that of the cavity 172, however, the diameter 160*a* is desirably larger than that of the cavity 172. Specifically, the diameter of the gate hole 160*a* is desirably the same as that of the focusing control hole 140*a* or larger.

Figure 5:
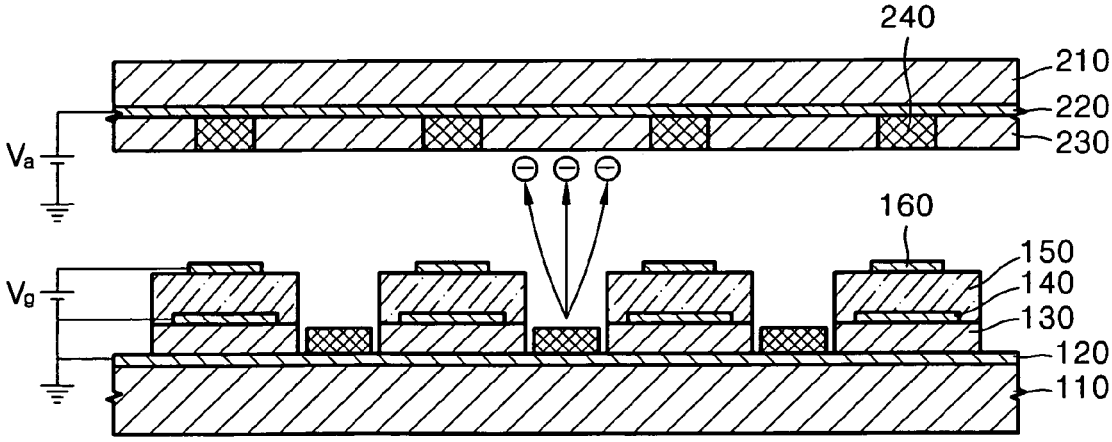
FIG. 5 is a view showing a field emission display (FED) according to another exemplary embodiment of the present invention.

FIG. 5 is a view showing a field emission display according to another exemplary embodiment of the present invention, and the same reference numerals denote the same elements as those of the above embodiment and detailed descriptions for those elements will be omitted.

Referring to FIG. 5, a field emission display (FED) includes an electron emission unit and a light emitting unit. The electron emission unit includes the above field emission device formed on the rear substrate 110.

The light emitting unit includes a front substrate 210, an anode electrode 220 formed on the front substrate 210, and fluorescent layers 230 on the anode electrode 220. A black matrix 240 is disposed between the fluorescent layers 230 for improving chromatic purity.

Operation of the FED having the above structure will be described with reference to FIG. 5. A pulse voltage (Va) of 1.5 kV is applied to the anode electrode 220, the fist and second cathode electrodes 120 and 140 are common electrodes, and a voltage (Va) of 80V is applied to the gate electrode 160. Here, the electrons are emitted from the electron emission source 190 by application of the gate voltage Vg. The electrons move to the anode electrode 220 after being focused by the focusing control electrode 140. Thus, the electrons excite the fluorescent layers 230, and the fluorescent layers 230 emit visible rays.

Figure 6:
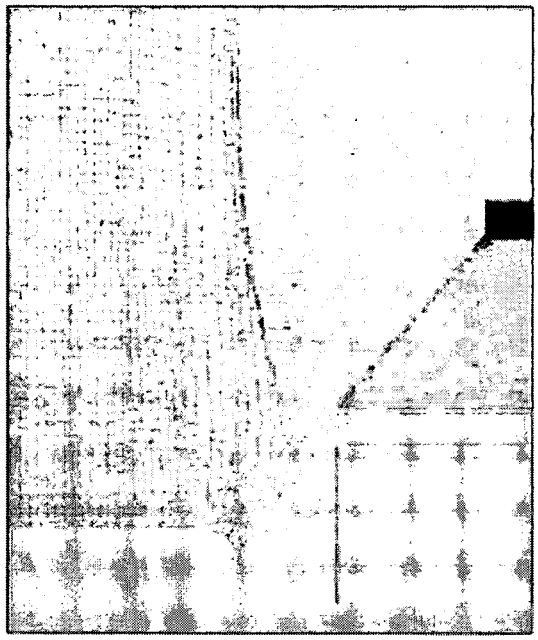
FIGS. 6 and 7 are views showing simulation results of electron beam emission in the FED display shown in FIG. 5 according to the present invention.
Figure 7:
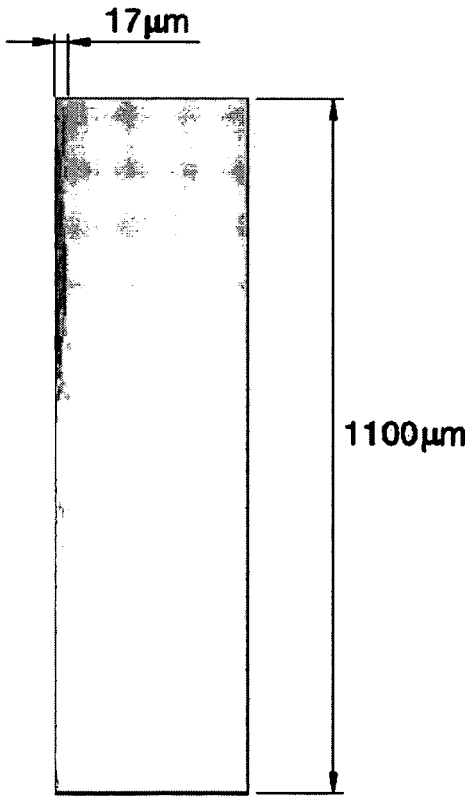

FIGS. 6 and 7 are views showing simulation results of electron beam emission in the FED display of FIG. 5. In the simulation, the first and second cathode electrodes 120 and 140 are grounded, and a voltage of 80V is applied to the gate electrode 160.

Figure 3:
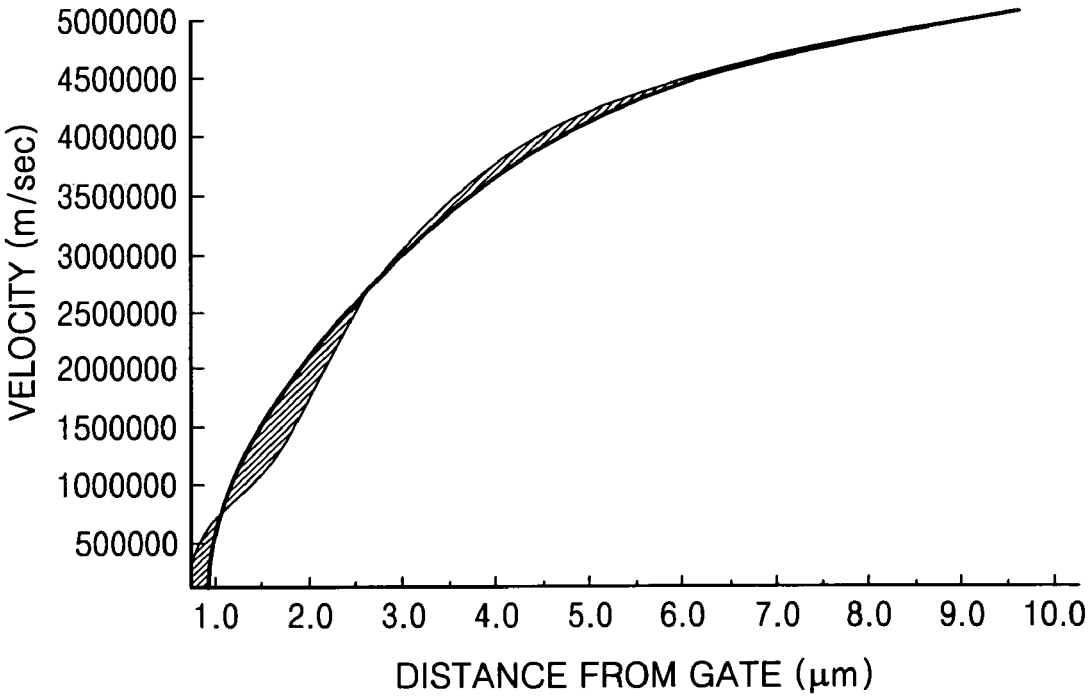
FIG. 3 (PRIOR ART)
FIG. 3 is a graph showing a simulation result of electron speed at a position apart from a gate electrode.

Referring to FIG. 6, the electrons emitted from the electron discharging source 190 are focused by the second cathode electrode 140. Since the initial velocity of the electron is slow as described in reference to FIG. 3, the electrons are easily focused.

Referring to FIG. 7, the electron beam is focused onto the anode electrode 220 that is separated about 1.1 mm from the substrate 110 so that the radius of the electron beam can be about 17 μm.

Also, the second cathode electrode 140 and the gate electrode 160 do not directly contact the electrons, thus the electrodes 140 and 160 are protected from the electron beam. Therefore, stability of the field emission device can be improved.

Figure 8:
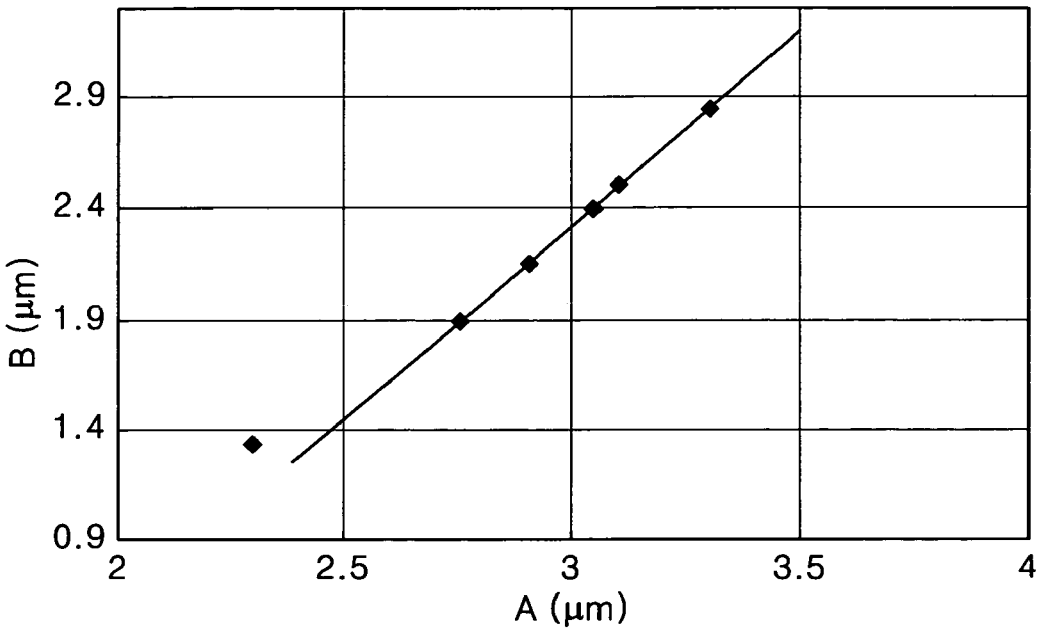
FIG. 8 is a graph showing the relationship between a radius (A) of a cathode hole, and a height (B) between a carbon nanotube (CNT) emitter and the second cathode electrode, which influence the diameter of the electron beam.

FIG. 8 is a graph showing the relationship between the radius (A) of the second cathode hole 140*a* and the height (B) between the electron emission source 190 and the second cathode electrode 140, which dimensions affect the diameter of the electron beam. In order to form the beam width shown in FIG. 7, the ratio between the radius A of the cathode hole 140*a* and the height B should be maintained constant. When A is increased to the right side of the graph, the width of the electron beam is increased, and when B is increased to the left side of the graph, the width of the electron beam is reduced.

As described above, the field emission device according to the exemplary embodiments of the present invention includes a second cathode electrode arranged at a position that is higher than that of the electron emission source. Thus, the electrons emitted from the electron emission source on the first cathode electrode are focused by the second cathode electrode and before the electrons are rapidly accelerated, thereby improving the ability to focus the electron beam. Also, according to the FED display of the invention including a field emission device, chromatic purity is improved. As a result, the number of scan lines can be increased relative to the conventional art for screens of the same size. Thus, a high quality image can be realized.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A field emission device comprising:

a substrate;

a first cathode electrode formed on the substrate;

a cathode insulating layer formed on the first cathode electrode, and having a first cavity that exposes a portion of the first cathode electrode;

an electron emission source disposed on the first cathode electrode, said electron emission source being exposed by the first cavity;

a second cathode electrode formed on the cathode insulating layer, and including a cathode hole aligned with the first cavity, wherein the cathode hole has a diameter that is larger than that of the first cavity;

a gate insulating layer formed on the second cathode electrode, and having a second cavity aligned with the first cavity; and a gate electrode formed on the gate insulating layer, and having a gate hole aligned with the second cavity.

2. The device as claimed in claim 1, wherein the first and second cathode electrodes are common electrodes.

3. The device as claimed in claim 1, wherein the gate hole has a diameter that is larger than that of the second cavity.

4. The device as claimed in claim 3, wherein the diameter of the second cavity is the same as that of the first cavity, and the diameter of the gate hole is larger than that of the cathode hole.

5. The device as claimed in claim 1, wherein the electron emission source comprises a carbon nanotube.

6. The device as claimed in claim 1, wherein the cathode insulating layer has a height, relative to the substrate, that is higher than that of the electron emission source.

7. The device as claimed in claim 6, wherein the cathode insulating layer is formed to have a thickness of 2~3 μm.

8. The device as claimed in claim 1, wherein the second cathode electrode is formed to have a thickness of 100~150 μm.

9. A field emission display comprising:

a front substrate and a rear substrate facing each other with a predetermined interval therebetween;

an anode electrode and a fluorescent layer successively stacked on an inner surface of the front substrate;

a first cathode electrode formed on the rear substrate;

a cathode insulating layer formed on the first cathode electrode, and having a first cavity that exposes a portion of the first cathode electrode;

an electron emission source disposed on the first cathode electrode, said electron emission source being exposed by the first cavity;

a second cathode electrode formed on the cathode insulating layer, and including a cathode hole aligned with the first cavity, wherein the cathode hole has a diameter that is larger than that of the first cavity;

a gate insulating layer formed on the second cathode electrode, and having a second cavity aligned with the first cavity; and a gate electrode formed on the gate insulating layer, and having a gate hole aligned with the second cavity.

10. The display as claimed in claim 9, wherein the second cathode electrode is formed to have a thickness of 100~150 μm.

11. The display as claimed in claim 9, wherein the first and second cathode electrodes are common electrodes.

12. The display as claimed in claim 9, wherein the gate hole has a diameter that is larger than that of the second cavity.

13. The display as claimed in claim 12, wherein the diameter of the second cavity is the same as that of the first cavity, and the diameter of the gate hole is larger than that of the cathode hole.

14. The display as claimed in claim 9, wherein the electron emission source comprises a carbon nanotube.

15. The display as claimed in claim 9, wherein the cathode insulating layer has a height, relative to the substrate, that is higher than that of the electron emission source.

16. The display as claimed in claim 15, wherein the cathode insulating layer is formed to have a thickness of 2~3 μm.

* * * * *